United States Patent [19]

Edge

[11] Patent Number: 4,844,142

[45] Date of Patent: Jul. 4, 1989

[54] LOST FOAM SAND CASTING APPARATUS

[76] Inventor: Clarence L. Edge, 853 W. Heather, Mesa, Ariz. 85202

[21] Appl. No.: 203,333

[22] Filed: May 31, 1988

[51] Int. Cl.[4] ..... B22D 27/15; B22D 47/02

[52] U.S. Cl. ..... 164/253; 164/326

[58] Field of Search ..... 164/326, 253

[56] References Cited

U.S. PATENT DOCUMENTS 2,049,967 8/1936 Luton ..... 164/326 X 3,741,281 6/1973 Hauser-Lienhard ..... 164/326 X

*Primary Examiner*—Nicholas P. Godici

*Assistant Examiner*—J. Reed Batten, Jr.

*Attorney, Agent, or Firm*—Learman & McCulloch

[57] ABSTRACT

A lost foam sand casting system wherein patterns supported by holding rings in sand filled molds vaporize, when molten metal is poured into the molds and fills the voids created, to thereby form castings. The system includes an indexable turntable surrounded by a series of adjacent processing stations. The processing stations include a sand depositing and compacting mechanism for filling a mold in which a foam pattern has been placed, a pouring station with a ladle for pouring a measured volume of metal into each mold while a suction is applied to the bottom of the mold, cooling stations, and a mold emptying station. The turntable is supported for rotary travel by a series of floor mounted rollers and a hydraulic cylinder mechanism extends below the upper level of the rollers into engagement with pins depending at intervals from the turntable to index the turntable from station to station.

18 Claims, 5 Drawing Sheets

LOST FOAM SAND CASTING APPARATUS

FIELD OF THE INVENTION

This invention relates to lost foam casting systems wherein a combustible foam pattern disposed in a sand-filled mold is destructed when molten metal is poured into the mold and the molten metal fills the void created to form a casting of the shape of the pattern.

BACKGROUND OF THE INVENTION

Lost foam systems of the character described are known and have been used to successfully old castings of various metals, including aluminum.

The present system is designed to provide a more compact, economical system of continuous nature which will produce castings having improved characteristics in a reliable and efficient manner.

SUMMARY OF THE INVENTION

The system disclosed in the present application provides an indexible turntable, having a series of circumferentially arranged processing stations opposite and adjacent the turntable. These stations include a sand depositing mechanism for filling a mold or flask in which a foam pattern has been pre-placed, a downstream pouring station, having a furnace with an actuable ladle mechanism for pouring a measured volume of metal into the mold, cooling stations, and a downstream mold emptying station.

A single fluid pressure operated cylinder mechanism, fixed to an external frame member, is engageable and releasable with the turntable when indexing the turntable from station-to-station. This is believed quite remarkable when it is considered that the system may employ ten sand-filled flasks weighing in the neighborhood of 2000 pounds each, which are transported on a turntable which may weigh in the neighborhood of 10,000 pounds.

One of the prime objects of the present invention is to provide a continuous lost foam system for high production foundries which can be operated with a minimum of operator attention and requires the presence of a minimum of personnel to operate.

Still another object of the invention is to provide a continuous system which is compact in nature in the sense that it takes up what may be termed minimum space in the foundry, and which can be installed in the foundry without expensive alterations to the available space.

Another object of the invention is to provide a system of the type described which is economical to manufacture and use, and requires a minimum of maintenance.

A further object of the invention is to design a continuous lost foam casting system in which there is an efficient distribution and packing of sand around the pattern, and a more rapid in-flow of metal into the mold at the pouring station, so that castings without porosity problems are reliably produced.

Still another object of the invention is to provide a flexible system which will produce a wide range of metal castings of a precisely sized nature, and with a minimum of rejects.

Still a further object of the invention is to provide a system which is durable in operation and has a minimum of down-time.

Other objects and advantages of the invention will be pointed out specifically or will become apparent from the following description when it is considered in conjunction with the appended claims and the accompanying drawings.

IN THE DRAWINGS

Figure 1:
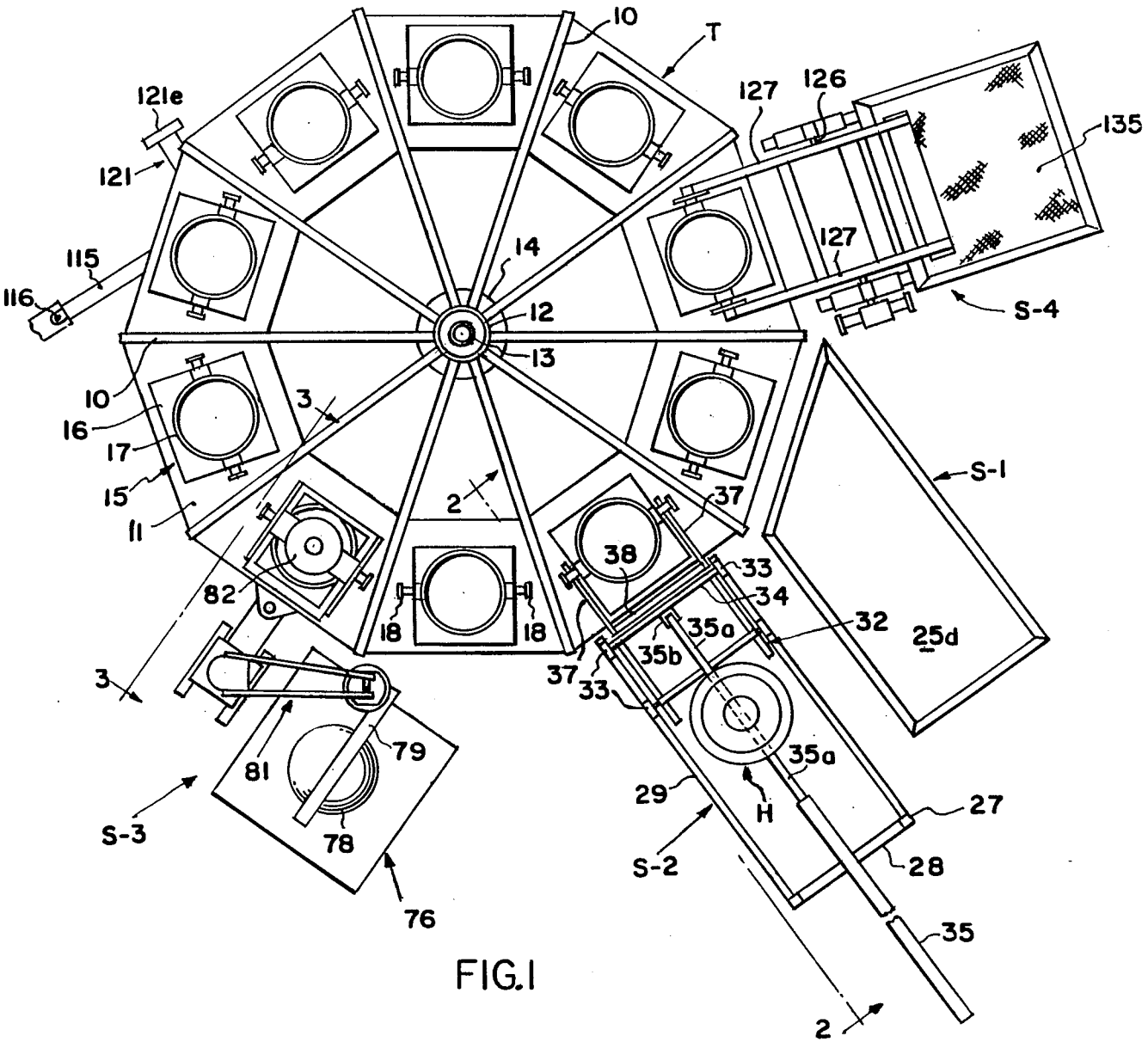
FIG. 1 is a somewhat schematic, top plan view illustrating the system and the various stations to which the molds or flasks are indexed in a continuous path.

Referring more now to the accompanying drawings, and in the first instance to FIG. 1, the system comprises a series of perimetrally disposed stations, generally designated S-1, S-2, S-3, and S-4, located externally adjacent the perimeter of an indexable, rotary, flask-transporting carrier table generally designated T. As FIGS. 1, 4, and 6 indicate, table T is made up of a series of radially extending beams 10, joined at their outer ends by segment plates 11, and at their inner ends by a hub 12 which is journaled on a fixed central shaft or trunnion 13, mounted on a fixed central floor supported pedestal 14. Supported on the segment plates 11 are a series of removable mold flasks 15, each of which comprises a laterally protruding base flange or bottom 16 affixed to a cylindrical barrel 17 having projecting shaft stubs or trunnions 18 extending in radially opposite directions at each side of each mold.

Affixed to the undersides of the table segments 11 are radially inner and outer support blocks 20 which are received and rotatably supported on fixed position, radially inner and outer rollers 21. The support rollers 21 are journaled on shafts 22 supported by bearing brackets 23. The brackets 23 are mounted on pedestal supports 24 fixed to the floor F of the plant in which the system is utilized. Rollers 21 are arranged to support the table T for rotary travel in a level plane, without the need for compensating for floor irregularity problems The brackets 23 may, for instance, be provided with a plurality of openings such as to provide vertical adjustability for the rollers and ensure that the segment platforms 11 can maintain the flasks 15 in a precise path of revolution at a given height to provide the precision indexing necessary at the various stations S-1 through S-4. Alternatively, the members 24 can be internally threaded sleeves mounted for vertical adjustment on screws fixed to the floor F.

It is to be understood that the emptied flasks 15 are provided with a plastic foam pattern P at station S-1. The foam pattern may be of the type shown in FIG. 8 which includes a central sprue S with a frustoconical head h, and gates leading to manifold shapes m which may be the products to be cast, for example. The pattern P is supported flexibly within each flask at the proper level by a floating pattern carrier ring R comprising an annular inversely disposed channel 25 fitting over the top edge of each flask and having rigid radial arms 25*a* connected with a pattern-supporting collar 25*b* by springs 25*c* which permit rotary and vertical shifting of the pattern P when the flask is being filled with molding sand, as will be later described. The ring R and pattern P are manually placed in position before the table indexes to the filling and compacting station S-2. Station S-1 comprises a platform 25*d* on which the operator may stand for performing the operation indicated. For the sake of convenience of illustration, the rings R and patterns P are not shown other than in FIG. 8 and 9.

Figure 2:
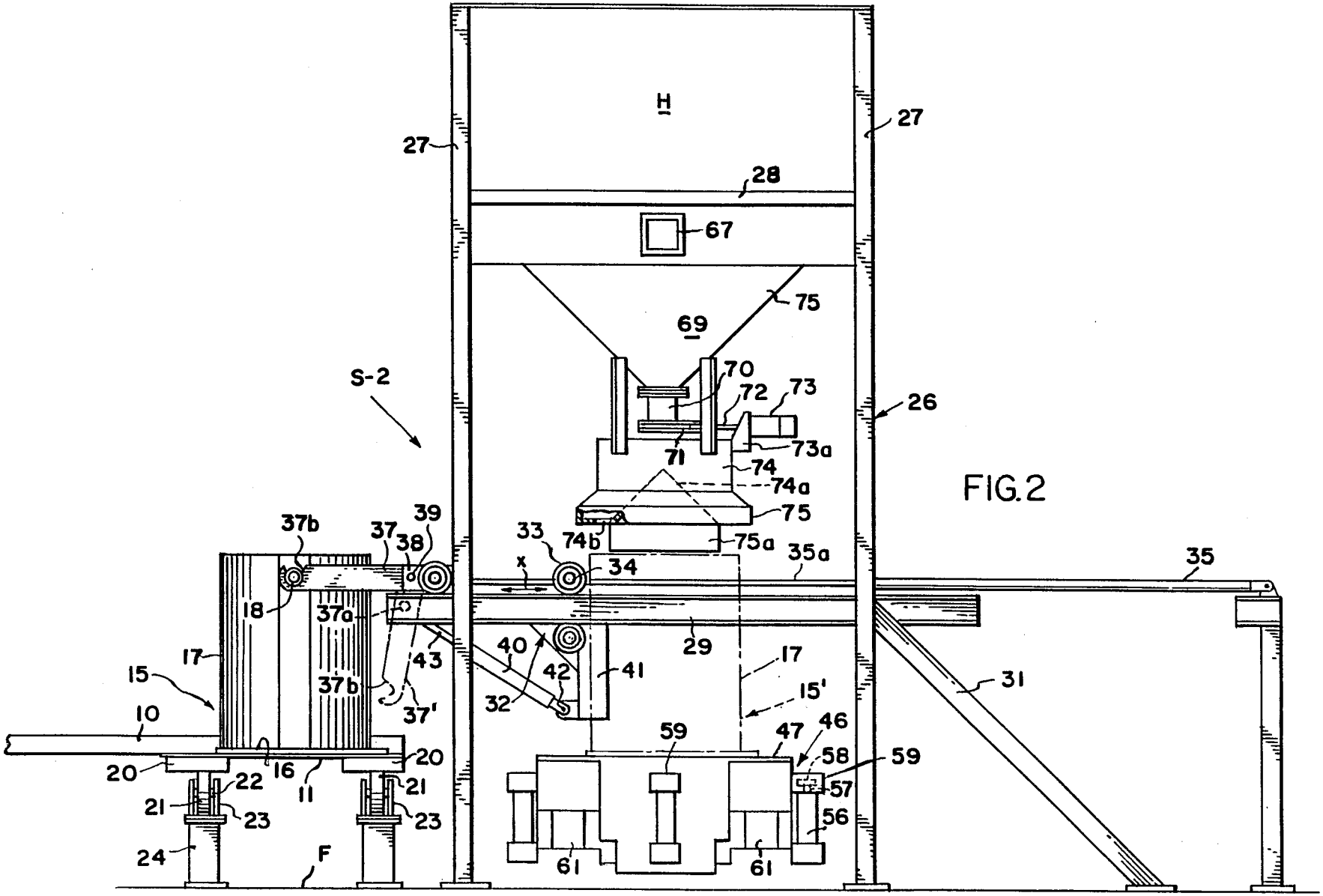
FIG. 2 is a partly schematic, side elevational view on an enlarged scale, taken on the line 2—2 of FIG. 1 and illustrating the molding sand filling and compacting station.

As FIGS. 1 and 2 particularly indicate, a framework generally designated 26 defines the sand filling and compacting station S-2, and includes upright columns 27 joined by braces or cross-members 28. Extending generally radially outwardly and affixed to the uprights 27, are fixed parallel rails 29, supported also by braces 31. A carriage generally designated 32, guided by sets of rollers 33 rotatably mounted on shafts 34, travels longitudinally in and out in the directions indicated by arrow x, when operated by a framework-mounted hydraulic cylinder 35 having its piston rod 35*a* connected to the carriage 32 at 35*b*. The carriage 32, at its front end, has pivotal lift arms 37, pivoted to a carriage cross-member 38 as at 39. A double-acting hydraulic cylinder 40, pivoted to an angle bracket 41 extending from the carriage 32 as at 42, has its piston rod 43 pivotally connected to a cross member 37*a* connecting arms 37, to move it from the chain line position shown in FIG. 2 to the solid line position illustrated, in which the sockets 37*b* provided in arms 37 engage under the trunnions 18 provided on the flask 15. It is the function of the arms 37 to lift the pattern-enclosing flask 15 about an inch or so off the platform 11 on which it is supported, and then to move it rearwardly by virture of rearward travel of the carriage 32 to dispose the flask in the chain line position indicated at 15' in FIG. 2. The flasks in the position 15' are supported on a vibratory table compacting platform, generally designated 46, and each may have its bottom flange 16 removably clamped to the upper platform 47 of the vibratory platform 46 by suitable clamps (not shown).

The vibratory platform 46 is shown only schematically, but, as usual, may comprise a series of vertical motors 56, with drive shafts 57 having eccentric portions 58 supported in bearings 59 on the upper platform 47. Horizontal motors 56 may also be provided so that vibration in both the vertical and horizontal planes is achieved. Upper platform 47 may be supported on isolation springs 61 in the usual manner. It is to be understood that the vibratory platform 46 is conventional in character and is illustrated only schematically.

Figure 5:
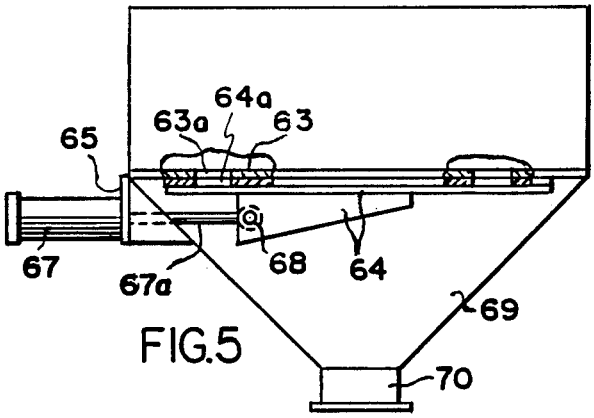
FIG. 5 is a fragmentary, partly schematic, side elevational view of the hopper used at the flask filling station.

Affixed to the framework 26, is a sand-filled hopper generally designated H, which has a false bottom 63 (see FIG. 5), with openings 63*a* which may be selectively closed by a slide gate 64 with like openings 64*a*. Mounted on a support 65, with a piston rod 67*a* connected to gate 64 as at 68, is an air cylinder 67. When the slide gate 64 is in a position of registration with openings 63*a* and 64*a* in vertical alignment, the hopper H will, over a designated period of time, deliver a designated quantity or charge of molding sand to the anti-segregation frusto-conical lower portion 69 of the hopper and into a discharge pipe section 70. The chamber 69 insures that blending of the heavier and lighter particles of sand occurs.

At the lower end of section 70 is a second slide plate 71 mounted by brackets 73*a* on a distribution housing 74. Slide plate 71 is connected with the piston rod 72 of an air cylinder 73 which is actuable to move slide plate 71 from a position in which it blocks the flow through pipe 70 to a position in which flow is permitted. The sand is delivered through distribution housing 74 over a conical deflector dam 74*a* which directs the sand to peripheral openings 74*b* around the bottom of the dam 7*a*. At the lower end of a dust collector 75, communicating with housing 74, a soft rubber block 75*a* substantially engages the slightly protruding top of sprue S. The openings 74*b* distribute the sand to the mold around the perimeter of the pattern P.

At the same time, the vibration of the platform 46 is controlled in terms of the speed of revolution of the eccentric shafts of vibrators 56, and the time of vibration, such that falling sand is tightly compacted around the preferably polystyrene foam pattern P in a densified enveloping layer which just leaves the top of sprue portion S exposed. Initially, the pattern P can float with respect to the flow of sand to avoid damage to the fragile pattern. After a predetermined time, carriage 32 moves from right to left in FIG. 2 to move the molding flask 15 out to the position in which it is shown in solid lines in FIG. 2. Once arms 37 drop to the broken line position shown at 37', the table T indexes the sand-filled flask to the next station S-3 in which it will receive the casting metal.

As FIG. 1 indicates, the station S-3 is one indexing step removed from the station S-2 but this is a matter of design rather than criticality. A melt furnace generally designated 76 houses a crucible 77 in which the aluminum ingots or other metal are heated to a molten condition. A dome-shaped lid 78 removably covers crucible 77 and a handle 79 secured to the top of crucible cover 78 is operable to enable the lid 78 to be lifted and swung out of the way, either manually or mechanically. Provided in conjunction with the furnace 76 is a ladle 80, mounted on a cylinder or motor operated robot device generally designated 81, to swing from the crucible 77, after filling, over to a position above a pouring funnel 82 which is mounted for raising and lowering movement with respect to the flask 15 beneath it.

Figure 3:
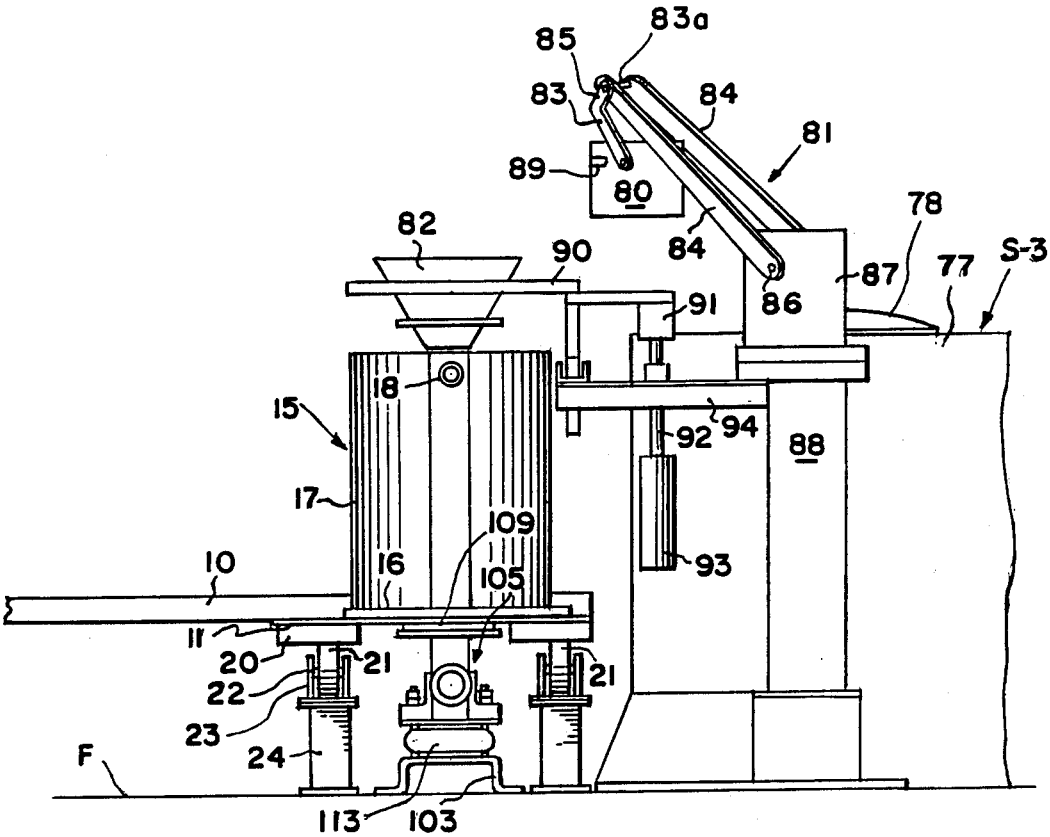
FIG. 3 is a partly schematic, side elevational view on an enlarged scale, taken on the line 3—3 of FIG. 1 and illustrating mechanism for supplying molten metal to the flask at a pour station.

As FIG. 3 indicates, ladle 80 is supported by arms 83, pivotally connected at 83*a* with arms 84 and 85 which are pivotally connected at 86 to a rotary head 87 mounted on a pedestal support 88. Robot 81 forms no part of the present invention and is included only for the purpose of indicating one mode of obtaining metal from the crucible 77 and transferring it to the pouring spout or funnel 82. When the robot 81 lowers the ladle 80 into the crucible 77, filling takes place through a filling opening 89, as ladle 80 is submerged in the molten metal, and the arms 84 are then raised to move the ladle 80 out of the crucible 77. Then head 87 is swung to dispose the ladle 80 over the funnel 82. Arms 83 can be swung to tilt the ladle and empty its contents into the funnel 82. When this occurs, the funnel 82 is in a lowered position with its lower end in engagement with the head of the sprue portion S of pattern P. The funnel 82 is supported by arms 90 connected with a mount 91 which is raised and lowered by the piston rod 92 of a cylinder 93 provided on a fixed frame portion 94 secured to pedestal 88.

Figure 7:
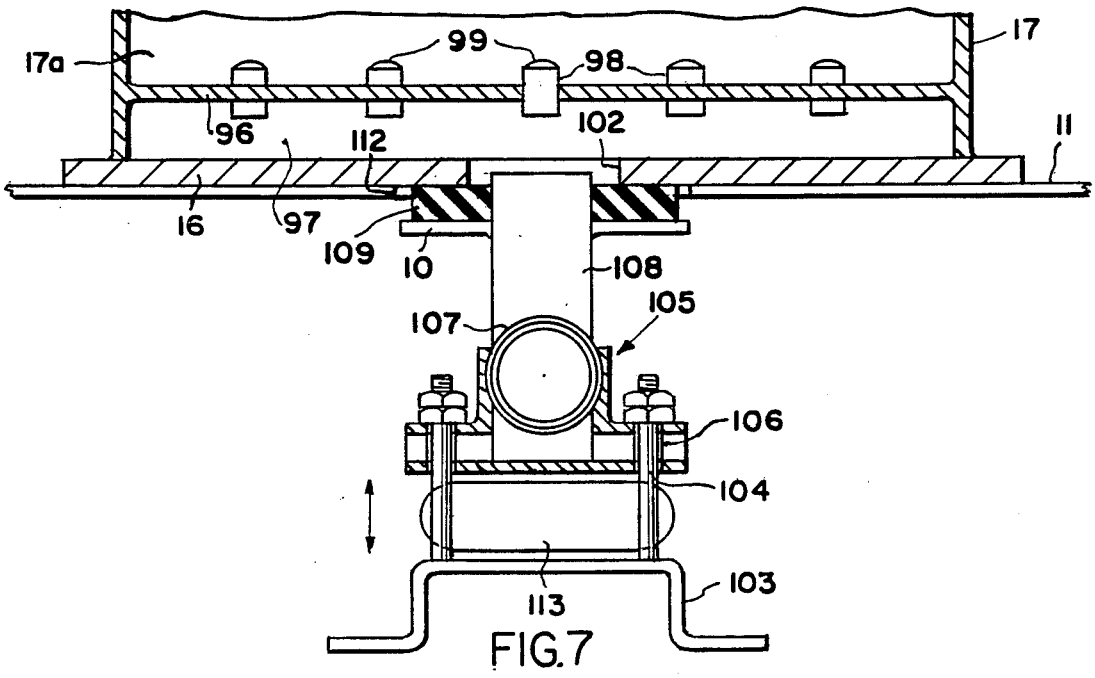
FIG. 7 is a fragmentary, partly sectional, side elevational view on an enlarged scale illustrating mechanism for applying a vacuum at the pour station to enhance the rapidity with which the molten metal vaporizes the foam pattern and supplants it in the cavities formed in the flasks.

As FIG. 7 discloses, a false bottom 96 is provided in the lower end of each flask 15 to define a mold chamber 17*a* and a plenum chamber 97 between the bottom 96 and bottom 16. Open-ended tubes 98 are provided in the false bottom 96 and are covered at their tops with very fine mesh screens 99. The purpose of this becomes apparent when it is recognized that an opening 102 is provided in the bottom wall 16 beneath the tube 98, and a vacuum-creating device is provided at the fill station S-3 centrally so as to align with opening 102. As FIG. 7 discloses, a pedestal support 103 has upstanding guide bolts 104 which vertically slideably receive a vacuum manifold 105 assembly having openings 106 to receive the slide bolts 104 The vacuum manifold assembly includes a pipe section or fitting 107 connected with a vertical tube 108 which is movable up into the opening 102 from a position below it, and below turntable T. A rubber manifold 109, supported on a plate 110, is provided for passing through an opening 112 in the turntable segment 11 to engage the bottom wall 16 of each flask at station S-3 Fitting 107 connects with a suitable vacuum pump and an inflatable and deflatable air bag 113 is provided for moving the vacuum assembly 105 up into operative position. A solenoid-operated valve alternately connected with a source of air under pressure and with the atmosphere may be provided to operate air bag 113. Because the molding sand is relatively coarse, it is not able to pass via the screens 99 into the bottom chamber 97 under the suction forces exerted. The suction forces exerted are, however, useful in pulling the molten metal into the flask more rapidly, such that a lower temperature molten metal can be utilized which avoids porosity in the castings molded, and in instantaneously eliminating the gases formed in the combustion vaporization of the foam pattern P. When the casting has been poured, the vacuum manifold assembly 105 is lowered via the deflation of the support air bag 113 so that the table T can be indexed.

Figure 6:
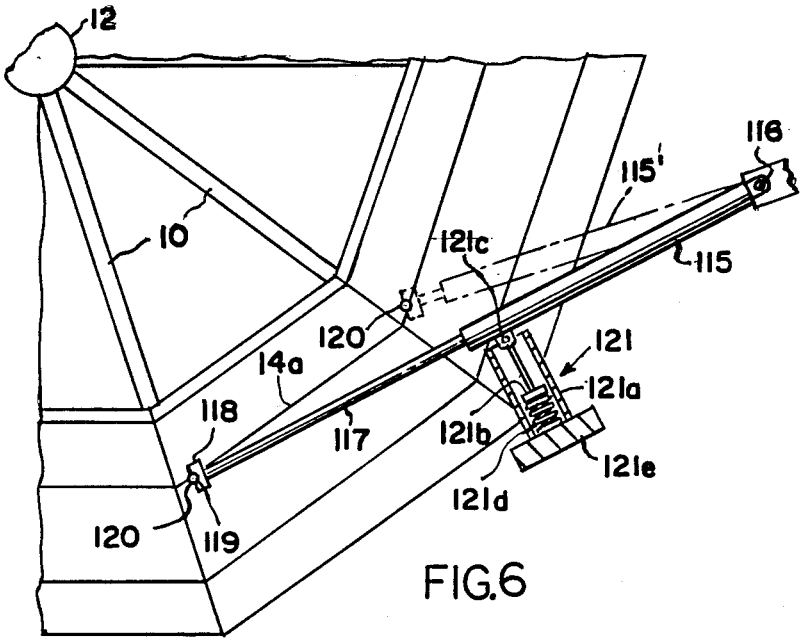
FIG. 6 is a fragmentary, partly sectional, underplan view, illustrating the mechanism for indexing the flask carrying rotary table.

Indexing of the table in a step by step fashion is accomplished as disclosed in FIG. 6 by a single hydraulic cylinder 115, pivotally attached as at 116 to a fixed cylinder support base. The cylinder piston rod 117 has a claw 118 with a pin receiving recess 119 adapted to engage one of the pins 120 which depend from the turntable T at the leading portion of each turntable segment 11. A spring device 121 normally maintains cylinder 115 in the broken line position shown at 115'. Spring device 121 may comprise a cylinder 121*a* for a member 121*b* which pivotally connects to cylinder 115 as at 121*c*. The coil spring 121*d* is in a state of compression at all times and exerts a lateral pressure through members 121*b* on the cylinder 115. Cylinder 121*a* is fixed to an upright fixed frame support 121*e* on floor F. However, when the piston rod 117 is extended, spring device 121 "gives" sufficiently to permit the cylinder 115 to swing to the solid line position in which it is shown in FIG. 6, and to push the pin 119 with which it is engaged until the piston 117 is in the fully extended position in which it is shown in FIG. 6. The piston 117 is maintained in this extended position during the time filling and pouring are accomplished to prevent any tendency of the turntable T to return. Once all operations required at a particular indexed position of table T are performed, piston rod 117 is returned to retracted position and the spring device 121 moves cylinder 115 laterally inwardly to the 115 position in which it cams to a position behind and aligned with the dependent pin 119 on the successive segment portion 11. Claw 118 bears on the side edge 14*a* during retracting movement of the piston rod 115*a*. Because only a single cylinder 115 is involved, problems with synchronization are avoided.

The stations following station S-3, and until ejection station S-4 is reached, as a given flask 15 is rotarily indexed on table T to ejection station S-4, are cooling stations. At the ejection station S-4, a pedestal support 125 supports a shaft 126 on which tilt arms 127 are journaled. Each of the pair of arms 127 pivotally supports a pair of scissors-like clamp jaws 128 and 129, which rotate about shafts 130 carried at the end of the pair of arms 127. Clamp jaws 128 and 129 are adapted to close about the trunnions 18 at each side of the flask 15, and once this has occurred, via the action of a hydraulic cylinder 131 having a piston rod 132 pivotally connected to the arms 127 as at 133, the arms 127 can be swung upwardly in the path indicated by arrow y and tilted over to empty the flask contents into a trough 134 having a screen 135. The metal castings are received on the screen 135 and can be removed therefrom with suitable overhead hoist devices, while the sand falls through the screen 135 and is conveyed via a pneumatic conveying system 136 back to the upper end of hopper H. A cross-bar 137 spanning the arms 127 is engaged by the side wall of the flask 15 as the arms 127 swing upwardly, it being important to understand that the flask 15 initially maintains an upright position as it is being lifted. This occurs because the jaws 128 and 129 can pivot with respect to the flask trunnions 18. When the sidewall of the flask 15 engages, and is supported by, the cross-rail 137, however, it should be apparent that flask 15 will tilt with the arms 127 sufficiently to achieve its emptying or discharge position, with the bottom flange 16 hooked over the rail 137.

THE OPERATION

Figure 8:
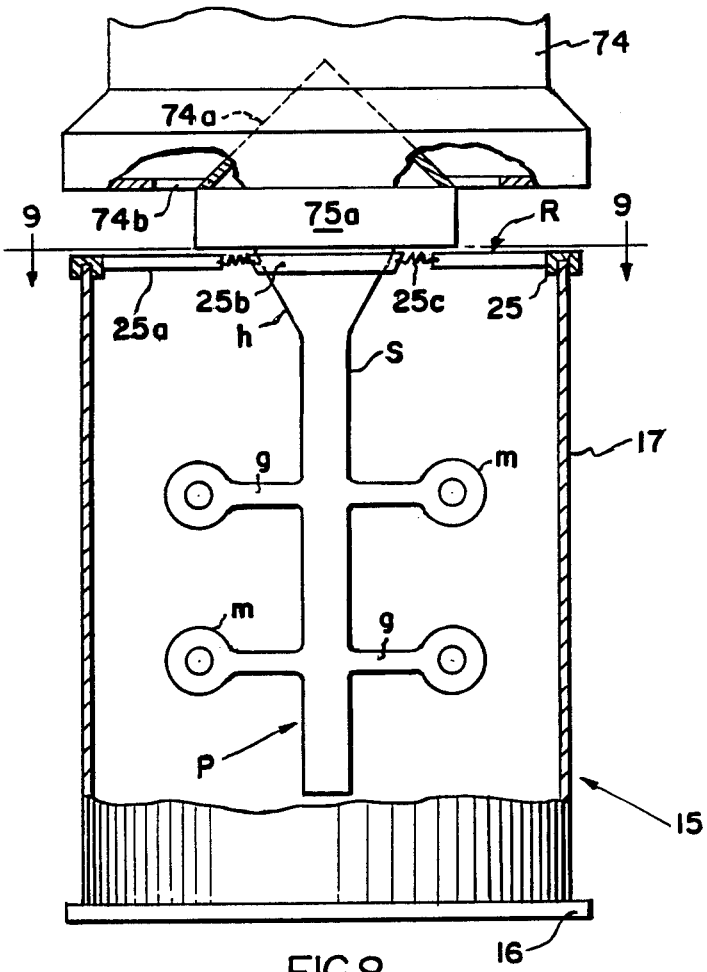
FIG. 8 is a fragmentary, sectional, side elevational view on an enlarged scale, showing a pattern held flexibly in position in a mold flask.
Figure 9:
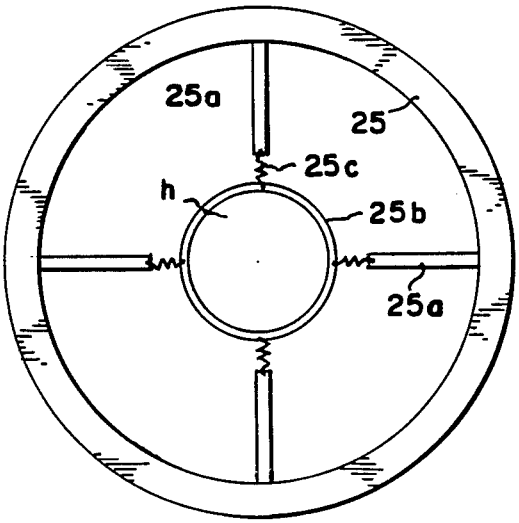
FIG. 9 is a top plan view thereof, taken on the line 9—9 of FIG. 8.

In operation, it will be assumed that a mold 15 has just been emptied and been indexed to station S-1 so that it is ready to cycle through the various stations once again. It is to be understood that the operator standing on platform 25*d* has at his disposal a supply of ring holders of the type disclosed in FIGS. 8 and 9 with the patterns in place. He will have ample time, while the turntable T dwells, to place a channel ring R over the top edge of the mold and dispose the pattern it carries in the position within the mold which is illustrated in FIG. 8. At the next index of turntable T, the pattern containing mold 15 will be stopped at station S-2 where arms 37 will be raised by the cylinder 40 from the chain line position shown in FIG. 2 to the horizontal position shown wherein trunnions 18 are accommodated within the trunnion sockets 37*b* of arms 37. Cylinder 35 will then be operated to withdraw its piston rod 35*a* and move the carriage 32 rearwardly to dispose the mold 15 in the chain line position shown beneath the mold sand charging hopper H.

Prior to this movement, cylinder 67 will have been operated to move the slide gate 64 to register the openings 63*a* and 64*a* and deliver a charge of material to the chamber enclosed by frustoconical wall 69. The cylinder 67 moves the gate 64 to closed position after a predetermined time period, so that a measured charge of molding sand is delivered. When mold 15 is in position beneath hopper H, the cylinder 73 will be operated to permit sand to empty through the passage 70 and fall to engage the conical dam 74*a* which distributes it via the openings 74*b* surrounding the perimeter of dam 74*a* peripherally into the open upper top of mold 15. At this time, the vibration device 46 is vibrating the table 47 and the sand packs tightly in around the pattern P. Initially, because of the ring holder R with springs 25*c*, the pattern P can twist and move, while the layer of sand builds up from the bottom of mold 15. With this initial float which is provided, pattern P will not tend to be damaged as it would if it were rigidly held in position As the sand builds up in the mold 15, it will, of course, pack in around the pattern in an even manner because of the vibratory action, and, while the springs 25*c* will tend to prevent distortion and fracturing the foam pattern P. Finally, the mold 15 will be filled substantially to its top with a well-densified sand body which is virtually solid and has no voids. All of this must take place in something like 90 seconds and then the double action cylinder 35 is actuated to move the carriage 32 and flask 15 to outer position once again. Finally, with the retraction of arms 37 to the 37' position via retraction of the piston rod of double acting cylinder 40, turntable T is ready to index once again.

The next index of the table T finds the sand-filled flask at a holding station and a subsequent index then indexes the sand-filled flask to the furnace station S-3. With the robot 81 having already moved to dip the ladle in the crucible in the furnace 76 and fill it with a precise charge of molten aluminum or other metal, the first step is the actuation of cylinder 93 to lower the funnel 82 to a position of engagement with the head h of the pattern P. At the same time air bag 113 is also inflated to move the manifold 109 up into a position of engagement with the bottom of the flask 15. The vacuum creating assembly exerts a suction force via the opening 102 in the bottom of flange 16 of mold 15 and the screened openings 98 in the false bottom 96 of the mold 15. Robot 81 is then actuated to swing the ladle 80 over to a pour position above funnel 82 and to tip the ladle 80 to very rapidly discharge its contents into the hopper 82. As the very hot molten metal proceeds from the funnel 82, it virtually instantaneously destructs the foam pattern P by combusting it, and fills the cavity formerly occupied by the foam pattern P with metal. The suction force applied speeds up the distribution of the molten metal and at the same time removes the gases which are formed in the combustion destruction of the pattern P. Once the measured charge of molten metal has been delivered, cylinder 93 is operated to raise the funnel 82 and bag 113 is deflated via a suitable cylinder-operated inflation and deflation valve or the like. During this time, an operator can remove the ring R from the top of the mold. Turntable T is then operated to continue to index the mold.

Figure 4:
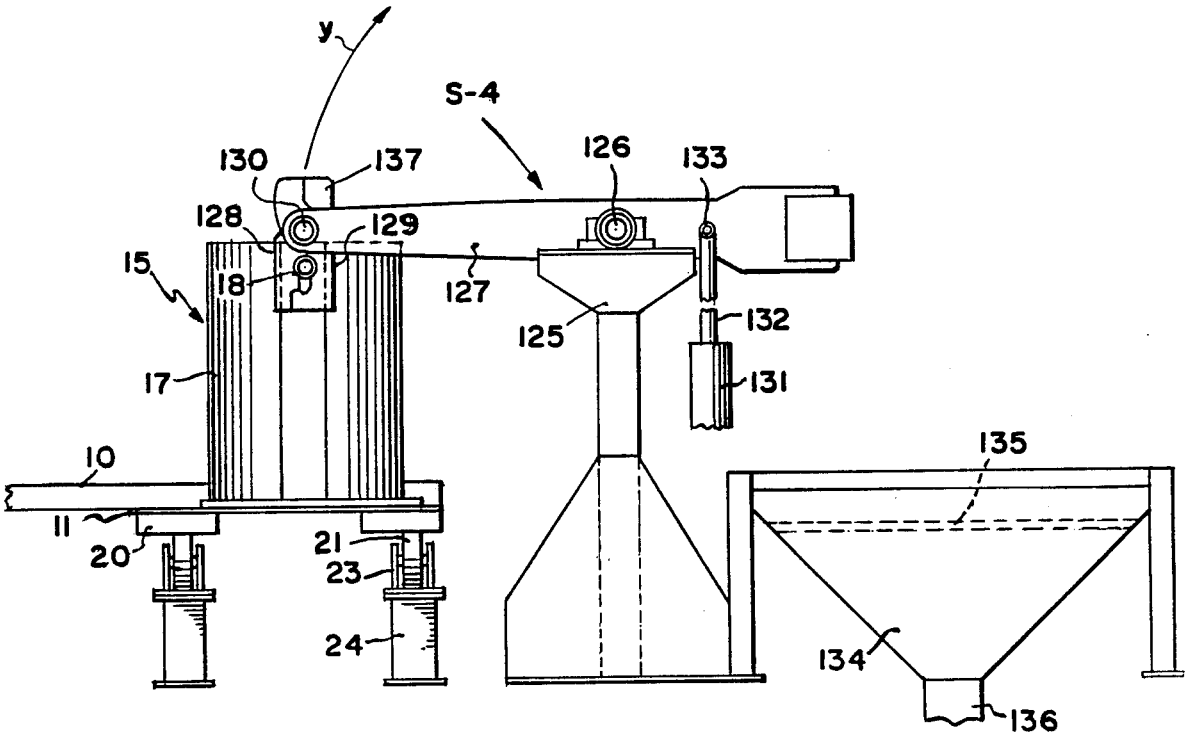
FIG. 4 is a party schematic, side elevational view on an enlarged scale, illustrating mechanism for tilting the flasks to empty them at a sand and casting discharge station.

The mold is transported step by step to the discharge station S-4 disclosed in FIG. 4 through a series of cooling stations. At station S-4, double acting cylinder 131 is operated to swing the arms 127 to a position in which the clamp jaws 128 and 129 which are initially in spread position to accommodate trunnions 18, receive the trunnions 18. Then clamp jaws 128 and 129 are closed by a suitable air cylinder (not shown). Cylinder 131 is energized to swing the arms 137 in the direction of arrow to lift mold 15. The closed jaws 128 and 129 can pivot with respect to the trunnions 18, and the mold 15 will be lifted in a linear path until one side engages brace 137. With brace 137 now in engagement with the side wall of mold 15, it will be plain that mold 15 will be tipped over to discharge its contents to the casting receiving device 134. The castings emptied out with the same, will remain on screen 135, whereas the sand will flow through the screen 135 and be transferred to a pneumatic conveying system 136. Pneumatic conveying system 136 will, in a known manner, deliver the hot molding sand to a sand cooling device which will cool it very substantially prior to delivering it once again to hopper H for reuse.

Only a single hydraulic cylinder 115, disposed below the level of turntable guides 20, is utilized to index the turntable T. As FIG. 6 discloses, spring device 121 at all times urges the cylinder 115 inwardly. At the time the turntable T reaches a dwell position, the piston rod 115*a* of cylinder 115 is retracted, with its claw 118 bearing against the wall 14*a* during this retracting movement because of the bias exerted by spring device 121. Finally, the claw 118 will reach a position just behind the rod 119 of one of the segments. When the turntable T is ready to be indexed, piston rod 115*a* is extended and the piston rod 115*a* will move from the position shown in the diagrammatic lines in FIG. 6 to the fully extended position shown in FIG. 6. In so doing, it will index the turntable T one increment. Since only a single cylinder need be involved, synchronization problems are not encountered, and the very significant weights involved are readily moved by only the single cylinder 115. With the apparatus disclosed, a wide variety of castings can be formed in a most rapid and economic manner with no porosity problems. Particularly, thin walled castings can be most reliably formed from molten aluminum and other metals.

While one embodiment of the invention has been described in detail, it will be apparent to those skilled in the art that the disclosed embodiment may be modified. Therefore, the foregoing description in all aspects is to be considered exemplary rather than limiting in any way, and the true scope of the invention is that defined in the following claims.

What is claimed is:

1. In a lost foam, sand casting apparatus wherein combustible foam patterns disposed in sand-filled molds are vaporized when molten metal is poured into the molds so that the molten metal fills the voids created to form castings of the shape of the patterns;

a. a series of circumferentially arranged processing stations;

b. a turntable, radially inward of and adjacent said stations, indexable in rotary increments and having a series of circumferentially spaced projections spaced to define increments of index to and from said stations;

c. said stations including a sand depositing mechanism for sequentially filling molds in which foam patterns have been placed, with sand;

d. means including a sand compaction table for packing the sand around the patterns;

e. one of said stations downstream from the sand compaction table comprising a furnace with actuable ladle mechanism for pouring a measured volume of metal into said molds;

f. said stations further including a mold emptying station; and g. a fluid pressure-operated cylinder mechanism having a withdrawable projection embracing claw engageable and releasable from said turntable projections and operable for indexing said turntable from station to station.

2. The apparatus defined claim 1 wherein said projections comprise a series of fixed, circumferentially spaced pins depending from said turntable, said fluid pressure-operated cylinder mechanism comprises a cylinder mounted for pivotal movement which has a piston rod with said claw on its outer end for accomodating said pins sequentially, and means is provided to bias said cylinder laterally inwardly.

3. The invention defined in claim 2 in which extending movement of the piston rod swings said cylinder outwardly in an arc as extension of the piston rod indexes the turntable to a position of dwell.

4. The invention defined in claim 3 in which a guide wall is provided on the underside of said turntable, and said biasing means comprises a spring means causing said claw to guide along the guide wall with retracting movement of the piston rod to thereby dispose the claw in a position rearward of the next successive pin on the turntable ready to engage it with the next indexing extension of the piston rod.

5. The invention defined in claim 1 wherein hopper mechanism disposed above a mold at the sand filling station delivers a measured charge of sand to the upper end of the mold peripherally outwardly of the pattern in the mold.

6. The invention defined in claim 5 wherein a pattern holding outer ring is sized to fit over the upper edge of each mold and has radial arms connecting the outer ring with a pattern holder, the arms being resiliently connected between the outer ring and pattern holder to permit adjusting movement of the fragile pattern and the mold during the sand filling operation.

7. The invention defined in claim 6 wherein the pattern holding member comprises an inner ring, and said pattern has a sprue portion with a frustoconical upper end received by said inner ring.

8. The invention defined in claim 7 wherein said turntable is supported for rotary travel on circumferentially spaced rollers arranged beneath the turntable in a fixed position, and said cylinder mechanism is pivotally mounted on a fixed support and extends below the upper level of said rollers to engage with the pins depending from the underside of said turntable to index the turntable.

9. The invention defined in claim 1 wherein said mold has a false bottom spaced from a bottom wall having an opening therein, the space between the false bottom and the bottom wall defining a plenum chamber and there being openings in the false bottom, with means for preventing the entry of sand to the plenum chamber, and wherein a suction creating device is provided at the pouring station disposed beneath the turntable and movable up to a position of engagement with the bottom of the mold at the opening in the bottom of the mold to communicate the suction creating device with the plenum chamber.

10. The invention defined in claim 1 wherein an air filled bag provided beneath the suction creating device is inflatable to move the suction creating device up into operating position.

11. A lost foam sand casting system wherein a combustible foam pattern disposed in a sand filled mold is combusted when molten metal is poured into the mold and fills the void created comprising:

a. a turntable indexable in rotary increments and carrying a series of circumferentially spaced molds having upper openings for receiving molding sand, the turntable having an opening beneath each mold;

b. means for indexing the turntable in increments of rotary movement punctuated by periods of dwell;

c. a series of circumferentially arranged stations opposite and adjacent the turntable including a vaporizable pattern depositing station, a sand depositing mechanism for filling a mold indexed to the sand depositing station, a pour station wherein a crucible and actuable ladle mechanism are operable to pour a measured volume of metal into the mold, cooling stations, and a mold emptying station;

d. each mold being formed with a false bottom and a bottom defining a plenum chamber in the lower end of the mold communicating with a mold chamber above the plenum chamber which is filled with sand around the pattern, there being an opening provided in the bottom wall of each mold in register with the opening in the turntable, and openings provided in the false bottom to communicate the plenum chamber and the mold chamber, the openings in the false bottom being provided with means to prevent the passage of molding sand into the plenum chamber; and e. a suction creating device at said pour station having a surrounding seal mounted for vertical movement from a position below said mold up through one of said openings in said turntable into sealed engagement with the bottom of the mold at the pour station to communicate with said plenum chamber via the opening in the bottom of said mold and create a suction which aids the rapid distribution of the molten metal.

12. The system defined in claim 11 wherein said indexing means comprises a single hydraulic cylinder pivotally mounted on a fixed frame to extend in under the turntable, said cylinder having a piston rod with a claw at its outer end, and said turntable having a series of dependent pins engageable and disengageable with said claw to permit said cylinder to index the turntable in increments o movement punctuated by periods of dwell.

13. The invention defined in claim 12 wherein said turntable is supported on a series of fixed position rollers arranged in circumferentially spaced position, and said cylinder extends in below the turntable at a level below said rollers.

14. A lost foam sand casting system wherein a destructible foam plastic pattern disposed in a sand filled mold is combusted when molten metal is poured into the mold and the molten metal fills the void created to form a casting of the shape of the pattern comprising:

a. a turntable indexable in rotary increments;

b. mechanism for indexing said turntable in increments of movement punctuated by periods of dwell;

c. a series of circumferentially arranged stations adjacent the turntable including a sand depositing station for filling a mold, a pouring station with a molten metal filled crucible and a ladle mechanism for pouring a measured volume of molten metal into a mold indexed to the pouring station, cooling stations, and a mold emptying station;

d. an overhead hopper supply system at the sand depositing station for delivering a measured charge of sand to a mold indexed to the station and a vibrating compaction table at the station;

e. a pattern holding ring configured to fit over the top of the mold and having an outer member and an inner member connected by support arms, the inner member supporting the pattern; and f. means resiliently connecting the arms between the outer member and the inner member to support the pattern in a manner to permit it to float laterally and vertically and avoid destruction of the pattern when sand is being charged to the mold.

15. The invention defined in claim 14 wherein said latter means comprises spring means connecting the inner ends of said arms with said pattern holding inner member, the pattern having a central sprue with an enlarged conical head which is engaged within the inner member.

16. The invention defined in claim 14 wherein each mold has a false bottom defining a mold chamber for receiving the pattern in sand above the false bottom, and a bottom wall defining a plenum chamber with the false bottom; there being openings in the false bottom communicating the plenum chamber with the mold cavity, and means for preventing the entrance of sand into the openings; the bottom wall having an opening therein and suction creating means being movable from a position below a mold at the pouring station up into a position of engagement with the opening in the bottom of the mold to create a suction which aids in drawing the molten metal rapidly into the mold cavity created by the destruction of the pattern.

17. The invention defined in claim 14 wherein said indexing means comprises a single hydraulic cylinder pivotally connected to a fixed support and extending in under the turntable, the cylinder having a piston rod with a claw, and the turntable having a series of dependent pins engageable by the claw to push the pins and index the turntable.

18. The invention defined in claim 14 wherein means is provided for transferring a mold delivered to the sand depositing station from the turntable to the compaction table and returning it to the turntable.

* * * * *

UNITED STATES PATENT AND TRADEMARK OFFICE

CERTIFICATE OF CORRECTION

PATENT NO. : 4,844,142

DATED : July 4, 1989

INVENTOR(S) : Clarence L. Edge

It is certified that error appears in the above-identified patent and that said Letters Patent is hereby corrected as shown below:

Column 1, line 13, change "old" to -- mold -- .

Column 3, line 10, insert -- g -- after "gates".

Column 5, line 68, insert -- rod -- after "piston".

Column 6, line 7, change "115" to -- 115' -- .

Column 6, line 9, change "119" to -- 120 -- .

Column 6, line 11, change "115a" to -- 117 -- .

Column 7, line 20, cancel "will".

Column 8, line 2, insert -- y -- after "arrow".

Column 8, line 27, change "115a" to -- 117 -- .

Column 8, line 28, change "115a" to -- 117 -- .

Column 9, line 28, change "1" to -- 2 -- .

UNITED STATES PATENT AND TRADEMARK OFFICE

CERTIFICATE OF CORRECTION

PATENT NO. : 4,844,142

DATED : July 4, 1989

INVENTOR(S) : Clarence L. Edge

It is certified that error appears in the above-identified patent and that said Letters Patent is hereby corrected as shown below:

Column 10, line 48, change "o" to -- of --.

Signed and Sealed this

Seventeenth Day of April, 1990

*Attest:*

HARRY F. MANBECK, JR.

*Attesting Officer*

*Commissioner of Patents and Trademarks*